United States Patent [19]

Okada et al.

[11] Patent Number: 4,932,251

[45] Date of Patent: Jun. 12, 1990

[54] METHOD OF PRODUCING A CORE FOR A FUEL INJECTOR

[75] Inventors: Setsuo Okada, 21-3 Miharu-cho, Minami-ku, Nagoya-shi, Aichi-ken; Akashi Yamazaki, Takahama, both of Japan

[73] Assignees: Miyamatool Kabushikikaisha; Setsuo Okada, both of Japan

[21] Appl. No.: 288,217

[22] Filed: Dec. 22, 1988

[30] Foreign Application Priority Data

Dec. 22, 1987 [JP] Japan ..... 62-325050
Jun. 17, 1988 [JP] Japan ..... 63-149774

[51] Int. Cl.[5] ..... B21K 21/08

[52] U.S. Cl. ..... 72/334; 72/354; 72/356; 72/353.2

[58] Field of Search ..... 72/254, 333, 334, 338, 72/354, 356

[56] References Cited

U.S. PATENT DOCUMENTS 3,237,288 3/1966 Hogan et al. ..... 72/254

FOREIGN PATENT DOCUMENTS 94748 7/1980 Japan ..... 72/354
97834 7/1980 Japan ..... 72/356

*Primary Examiner*—Lowell A. Larson
*Attorney, Agent, or Firm*—William A. Drucker

[57] ABSTRACT

A bar-like workpiece is axially compressed to form a flange at the intermediate portion thereof. Then, the workpiece with the flange is held by dies and its one axial end surface is received by a receiver die. The receiver die has a recess formed at the central portion of its end surface for accommodating a slug flowing from the workpiece. The end surface of the receiver die around the recess forms a surface to receive the workpiece. From the side opposite to the receiver die a punch is continuously pressed into the workpiece beyond the flange position to form a sleeve insertion hole. Next, a residual material left at the bottom of the sleeve insertion hole is punched out by another punch, completing the fuel injector core.

7 Claims, 10 Drawing Sheets

METHOD OF PRODUCING A CORE FOR A FUEL INJECTOR

BACKGROUND OF THE INVENTION

1. Field of the Invention

This invention relates to a fuel injector core and more particularly to a core accommodating a sleeve in the fuel injector.

2. Description of the Prior Art

Many of known fuel injectors have the construction as shown in FIG. 31. In the figure, reference numeral 201 indicates a cylindrical body. Installed in this body 201 are a cylindrical core 202 and a cylindrical armature 203, both of which are made of magnetic material. Formed at the middle of the core 202 is a flange 204 for magnetic path which is connected at its circumference with the body 201. The outer circumferential surface 205 of the retractable armature 203 is supported by the inner surface of the body 201 so that the armature 203 can be moved back and forth freely. Around the core 202 is arranged a coil 206 for generating a magnetic field. When the coil 206 is energized, the armature 203 retracts against the force of a coil spring 207 to allow fuel to be injected from a nozzle 208. The rear end 209 of the coil spring 207 is supported on a sleeve 211 installed inside a sleeve insertion hole 210 of the core 202.

If the force of the coil spring 207 in the fuel injector 200 is too strong, the operation timing of the armature 203 is delayed. When it is too weak, the armature operation timing becomes early. Any delay or advance in the armature operation timing will result in the amount of injected fuel becoming inappropriate.

To avoid this problem requires the spring 207 to be adjusted at a proper spring force. For this purpose, when the sleeve 211 is inserted into the insertion hole 210, a measuring device (not shown) is used to measure a repulsive force the sleeve 211 receives from the spring 207. As the amount of insertion of the sleeve 211 gradually increases, so also the repulsive force increases. When a proper repulsive force is obtained, insertion of the sleeve 211 is stopped and at this position the sleeve 211 is securely and correctly fixed to the core 202 without any deviation.

If, however, there is a frictional resistance against the sleeve insertion between the outer circumferential surface of the sleeve 211 and the inner circumferential surface of the insertion hole 210, an error will occur in the measured value of the repulsive force of the spring 207. To prevent this error, the inner surface of the insertion hole 210 must be finished smooth. Another measure may be to enlarge the inner diameter of the insertion hole 210 with respect to the outer diameter of the sleeve 211. However, increasing these dimensions makes the above work—"where the insertion of the sleeve 211 is stopped the sleeve 211 is securely and correctly fixed to the core 202 without any deviation"—impossible. That is, when the gap between the core 202 and the sleeve 211 is large, the sleeve 211 will be slightly off-centered with respect to the core 202 when it is caulked to the core 202. This in turn shifts the relative position of the sleeve 211 with respect to the rear end of the spring 207, changing the force of the coil spring 207.

Under these circumstances, the conventional practice necessarily involves many processes in finishing the inner surface of the sleeve insertion hole 210. That is, the sleeve insertion hole 210 of the core is bored by a drill, finished by a reamer and then buff-finished. However, on the inner surface of the insertion hole 210 that is bored by a drill, fine scores on the order of micron remain even after it is subjected to a series of finishing processes. These minute scores have delicate effects on the back-and-forth sleeve movement, which in turn causes small errors in the measured values of the repulsive forces. Furthermore, with the minute scores remaining on the inner surface of the insertion hole 210 that was cut by a drill, chips the size of microns will eventually fall from the scores, preventing the normal operation of the valve.

SUMMARY OF THE INVENTION

It is the object of the invention to provide a method of producing a core for a fuel injector, by which the dimensional accuracy of the inner surface of the sleeve insertion hole 210 in the core 202 can be enhanced and a smooth inner surface of the sleeve insection hole 210 can be provided so that the sleeve 211 can be advanced and retracted smoothly along the inner surface of the sleeve insertion hole 210.

That is, a method of producing a core for a fuel injector, according to this invention, comprises the steps of:

compressing a bar-like workpiece in the axial direction to form a flange at an intermediate portion of the workpiece;

holding the circumference of the workpiece formed with the flange by dies, and receiving one axial end surface of the workpiece by a receiver die, the receiver die having the central portion of its end surface formed into a recess to accommodate a slug extruded from the workpiece, the circumferential surface of the receiving die being adapted to receive the workpiece;

continuously pressing a punch into the workpiece from a side opposite to the receiver die beyond the flange position up to a specified depth; and punching out by another punch a residual material left at the bottom of the hole which was formed by pressing the first punch into the workpiece.

This invention is characterized in that after the flange is formed through plastic deformation by compressing a bar-like workpiece, a punch is pressed into the workpiece to form the sleeve insertion hole. Therefore, once the sleeve insertion hole is made, there is no risk of its being deformed. This means that the invention is effective in maintaining the straight geometry of the sleeve insertion hole.

Another feature of the invention is that the receiver die that receives the workpiece has a recess. As the punch is pressed into the workpiece from one side, a part of the workpiece material flows toward the recess of the receiver die. As a result, the resistance against the punch decreases to the extent of the plastic flow of the material and thus the punch can move continuously, in one stroke, throughout the entire region of the sleeve insertion hole including the flange portion.

Since the punch can be continuously pressed into the flanged workpiece throughout the entire region of the sleeve insertion hole, the whole inner surface of the sleeve insertion hole in the core can be formed smooth. Moreover, since the punch can be moved continuously through the entire region of the sleeve insertion hole, the number of processes required to form the hole is reduced, which in turn reduces the manufacturing cost of the core.

DESCRIPTION OF THE PREFERRED EMBODIMENT

Figure 1:
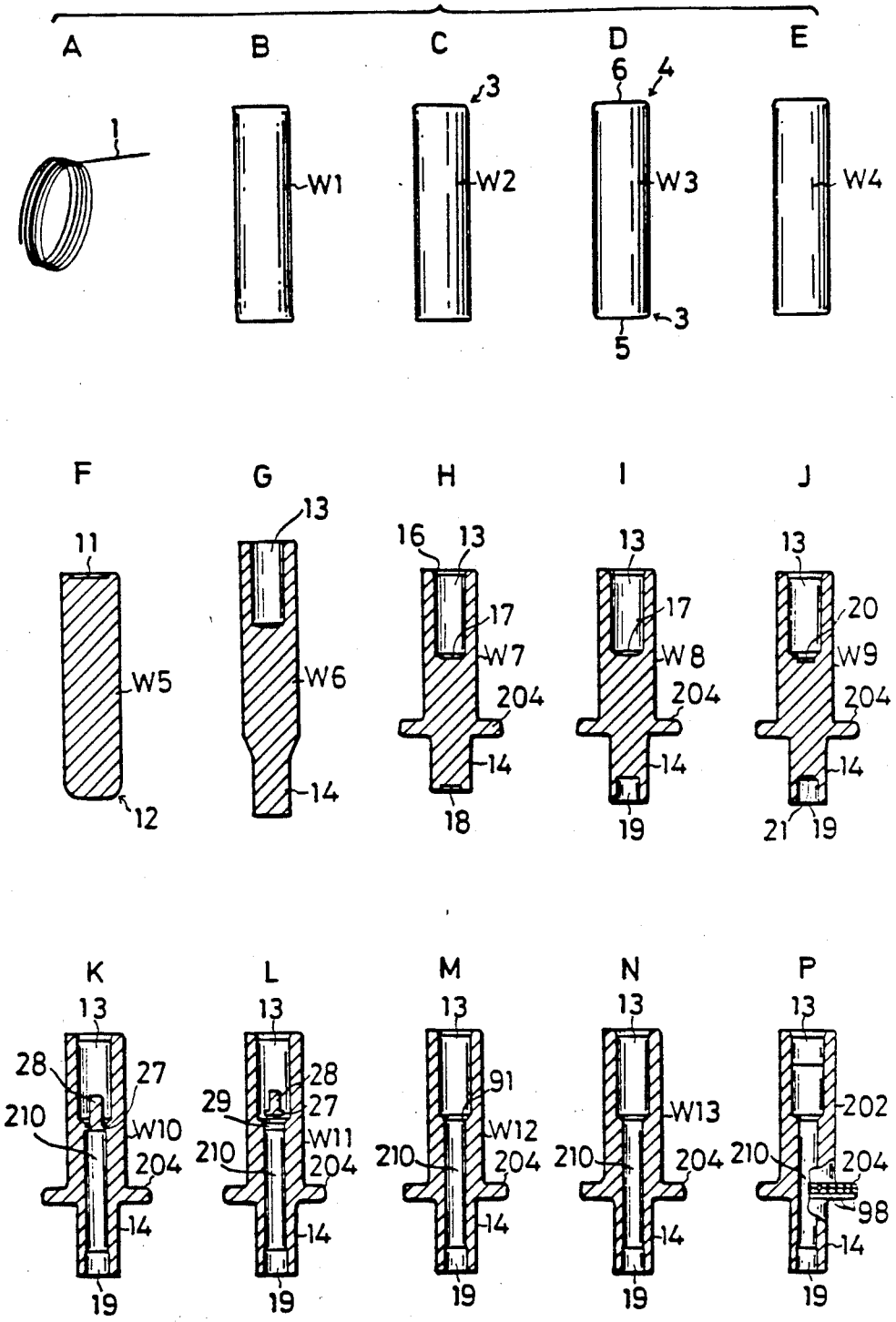
FIG. 1 shows a series of shapes of a workpiece at different stages of forming as the rod-like workpiece cut from a bar material undergoes a sequence of various forming processes to be formed into a core.

As shown at A in FIG. 1, a material 1 is prepared which has a magnetic characteristic necessary for a core of the fuel injector. For example, an electromagnetic free-cutting stainless steel (described in U.S. Pat. No. 4,714,502) may be used, or an electromagnetic stainless steel equivalent to AISI405 steel of the United States Steel Material Standard may be used. The AISI405 steel contains about 13% chromium. The material 1 may, for instance, be formed in the shape of coil, as shown in the figure. It is also treated with an oxalic acid to form a protective film.

The coil material 1 is cut to a predetermined length to form a round rod workpiece W1 as shown in FIG. 1 at B. The workpiece W1 undergoes an upsetting process to remove shear droops caused by the cutting process. The workpiece is subjected to another process to round the circumferential edge 3 at one end to produce a workpiece W2 as shown in FIG. 1 at C. The workpiece W2 then has its circumferential edge 4 at the other end rounded to become a workpiece W3 as shown in FIG. 1 at D. The rounding of the edges is performed to prevent the formation of burrs in the next polishing process. This work is done simultaneously with, for example, the upsetting process.

Figure 2:
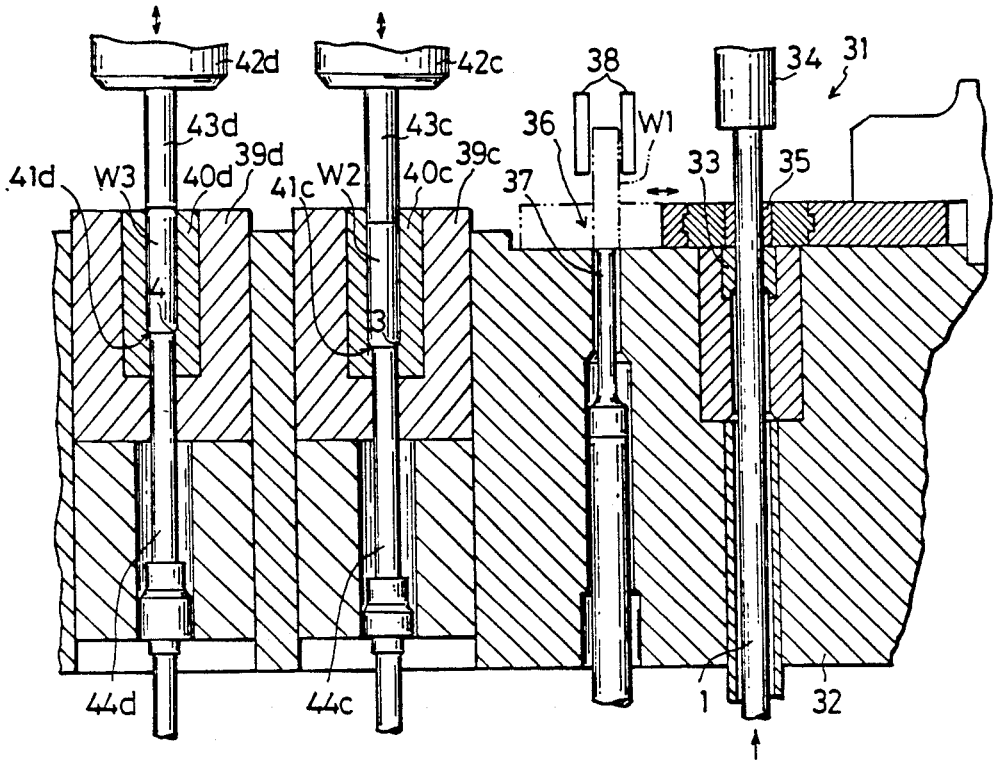
FIG. 2 is a cross-sectional view of a device used to form the workpiece into the shapes as shown in FIG. 1 at B, C and D.

The upsetting and the edge rounding are performed continuously by using, for example, a transfer former of FIG. 2. These processes may also be carried out by separate devices.

In FIG. 2 and FIGS. 5 to 25, members with similar functions are given identical reference numerals and they are also shown attached with alphabets that signify into which of the shapes C to P of FIG. 1 the members are used to form the workpiece (lower case alphabets c through L to p correspond to upper case alphabets C through L to P of FIG. 1, the latter alphabets representing different shapes and states of the workpiece). In the following description, similar explations for different members will be omitted.

The process of forming the workpiece by the device of FIG. 2 will be explained. The coiled material 1 is fed by a material feed roller to a cutting device 31 of FIG. 2. That is, the material 1 is fed from below upward in FIG. 2 so that it projects from a quill 33 mounted in a base 32. The projecting material 1 passes a round cutter 35 and is stopped by a stopper 34. Then the cutter 35 is advanced in the direction of arrow to cut the projecting material 1 to a specified length. Now, a round bar workpiece W1 of the specified length is obtained. The cutter 35 advances until it is on a pusher device 36. Then a pusher pin 37 of the pusher device 36 pushes the workpiece W1 out of the cutter 35. The workpiece W1 is held by a chuck 38, which was set ready to grip the workpiece. The chuck 38 then carries the workpiece W1 to the front of a die **40*c* mounted on a die case 39*c*. The die 40*c* has a rounding section 41*c* at the bottom of its cavity. The workpiece W1 carried over to the front of the die 40*c* is inserted into the cavity of the die 40*c*. Then, a punch 43*c* held by a punch holder 42*c* is advanced to press the workpiece W1 into the cavity of the die 40*c*. As a result, the workpiece W1 is upset in the cavity and its circumferential edge 3 at one end is rounded by the rounding section 41*c*. Now, a workpiece W2 is obtained. The punch holder 42*c* is mounted on a moving ram not shown in a manner well known. After the punch 43*c* is retracted, a knockout plunger 44*c* pushes the workpiece W2 out of the cavity of the die 40*c*. The workpiece W2 is gripped again by the chuck 38. The chuck 38 turns the workpiece W2 180° to invert it and carries the inverted workpiece to the front of the next die 40*d*, where it is upset. That is, the workpiece W2 is inserted into the cavity of the die 40*d* and pressed by a punch 43*d*. As a result, the circumferential edge 4 on the other end of the workpiece W2 is rounded by a rounding section 41*d*. Now a workpiece W3 is obtained. After the punch 43*d* is retracted, a knockout plunger 44*d* pushes the workpiece W3 out of the cavity of the die 40*d***. The workpiece W3 thus pushed out is then carried to the next process.

The workpiece W3 is polished at both end surfaces 5, 6 so that the end surfaces are normal to the axis. As a result, a workpiece W4 shown at E of FIG. 1 is obtained. This polishing is done to smooth the rough end surfaces 5, 6 which were produced when the material 1 was cut. When the punch is rammed against the end surface 5 or 6 during the process of forming the workpiece into the shapes shown at F to K of FIG. 1, a part of the workpiece material is easily scaled off from the rough end surface by the punch. The scaled particles get caught and remain embedded in the inner surface of a hole that is formed by the punch. These particles come off when the injector is assembled or when the completed injector is operated, causing the clogging of a nozzle. The smoothing of the end surfaces, however, removes this problem. The polishing also makes a large number of workpieces W4 the same length. The large number of workpieces W3 are made uniform in diameter by the upsetting process. The workpieces W4 made uniform in length therefore have the same weight.

Figure 3:
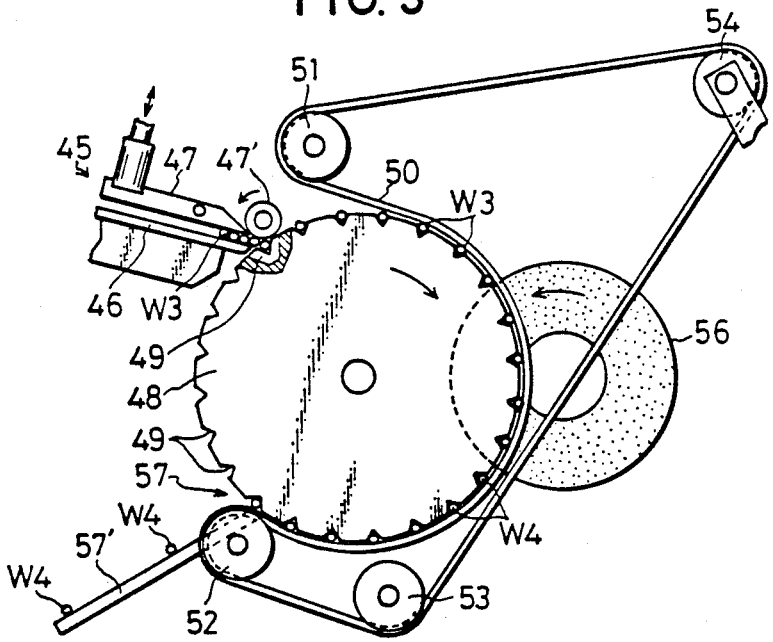
FIG. 3 is a partially cutaway side view of a device used to polish the end surface of the work piece.
Figure 4:
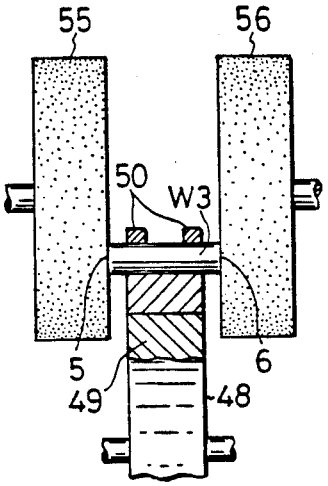
FIG. 4 is a partially cutaway view showing the relationship between the workpiece carrier and a whetstone.

The polishing is done by a polishing device such as shown in FIGS. 3 and 4. The large number of workpieces W3 are arranged on a chute 46 of a feeder device 45 and held by retainers 47, 47'. The retainers 47, 47' operate as indicated by arrow to feed the workpieces one at a time onto material receiving recesses 49 formed in large numbers on a carrier 48. The workpieces W3 transferred onto the recesses 49 are held by a tract 50 and prevented from falling from the recesses 49. The tract 50 may be formed, for example, by a chain. The chain 50 is engaged with a number of sprockets 51–54 and moves as the carrier 48 rotates. The workpieces W3 in the receiving recesses 49, as the carrier 49 rotates, come between two rotating whetstones 55, 56, which polish the end surfaces 5, 6 of the workpieces. Now we obtain workpieces W4 as shown at E of FIG. 1. The workpieces W4 are carried by the rotation of the carrier 48 to a position marked 57 where they are released from the retaining action of the tract 50 and transferred from the carrier 48 onto a discharge chute 57' for delivery.

The polishing of the end surfaces 5, 6 may be carried out one side at a time. In stead of polishing, a shaving process may be used to remove unevenness on the end surfaces.

After being polished, the workpieces W4 are washed to remove cutting chips or oil adhering to the surfaces.

The cleaned workpiece W4 undergoes plastic forming processes to be formed successively into a series of shapes shown at F to I of FIG. 1 until it becomes a workpiece W9, which is shown at J of FIG. 1. The plastic forming into the shapes F to J are performed by cold forging machines. For example, these works are done by a transfer former with five stations, which are shown in FIGS. 5 to 9. This former has a die breast 30 with five stations, and a ram which is moved back and forth with respect to the die breast 30. As the ram moves toward and away from the die breast 30, the following actions are simultaneously performed at the five stations. These processes may also be done by separate forging presses.

The work piece W4 is first formed into a workpiece W5 as shown at F, which has a recess 11 at one end at the center. At the other end, the workpiece W5 has its circumferential edge 12 rounded so that the front end is slightly narrowed. The recess 11 is also called a center, which works as a guide for a punch when the workpiece is rammed by the punch in the next process. The rounded circumferential edge 12 facilitates the next drawing process.

Figure 5:
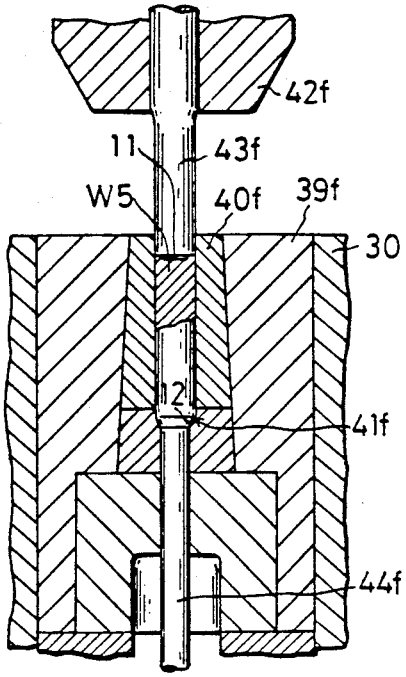
FIGS. 5, 6, 7, 8 and 9 are cross-sectional views of devices used to form the workpiece into the shapes of F, G, H, I and J of FIG. 1 (all in completed states)

These processes are performed by the station of FIG. 5. The workpiece W4 is inserted in the cavity of a die 40*f* and is rammed by a punch 43*f*. A knockout plunger 44*f* positions the end of the workpiece W4. As the punch 43*f* rams the workpiece W4, the recess 11 is formed and the circumferential edge 12 is rounded by a rounding section 41*f* at the bottom of the cavity of the die 40*f* to produce a workpiece W5. Then the punch 43*f* is retracted and the workpiece W5 is pushed out of the cavity by the knockout plunger 44*f*.

Next, the workpiece W5 is formed with a filter mounting hole 13 and a narrow diameter portion 14, as shown at G of FIG. 1, to produce a workpiece W6.

Figure 6:
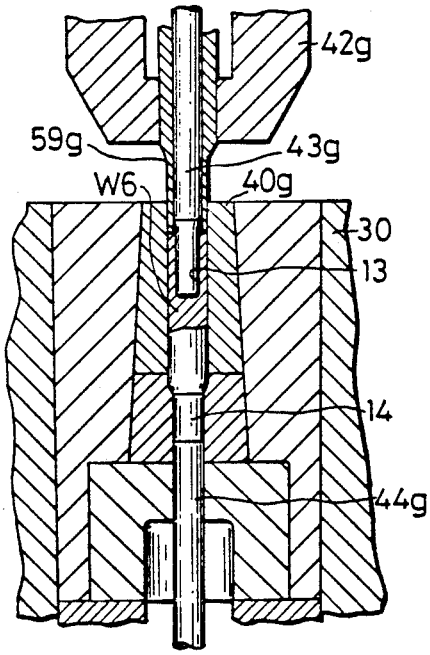

This stage of forming is done by the station of FIG. 6 in a manner similar to that of the previous process by using a die 40*g*, a punch 43*g*, a knockout plunger 44*g*, etc. to produce a workpiece W6. During this process the recess 11 is used to position the punch 43*g* with respect to the workpiece W5. As a result, the filter mounting hole 13 is correctly formed at the center of the workpiece W5 without any deviation. A stripper sleeve 59*g* guides the punch 43*g* so that the punch 43*g* advances in a straight line. When the punch 43*g* retracts from the die 40*g*, the stripper sleeve 59*g* holds the workpiece W6 against being drawn out of the die 40*g*, adhering to the punch 43*g*. The stipper sleeve 59*g* retracts after the punch 43*g* has retracted. In this process, since the workpiece W5 is already removed of shear droops, an inclination of the front end of the narrow diameter portion 14, if any, is very small.

The workpiece W6 is then formed with a flange 204 as shown at H of FIG. 1 to become a workpiece W7. The workpiece W7 undergoes three processes simultaneously, i.e., rounding of the circumferential edge 16 at the opening of the filter mounting hole 13, correction of angle of a circumferential edge 17 at the bottom of the filter mounting hole 13, and formation of a guide recess or a center 18 for the next process.

Figure 7:
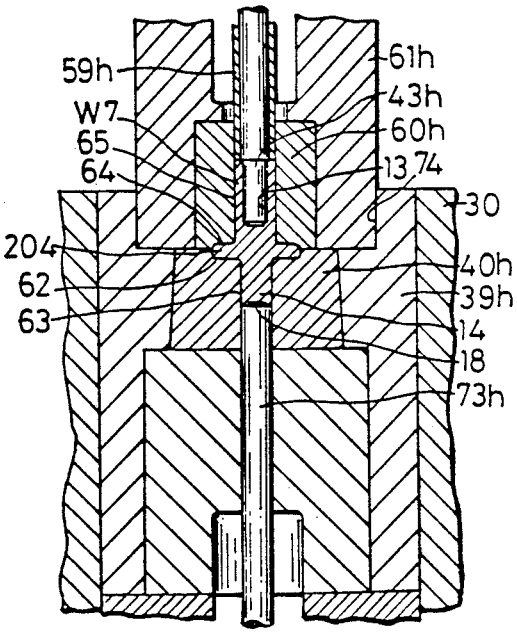
Figure 10:
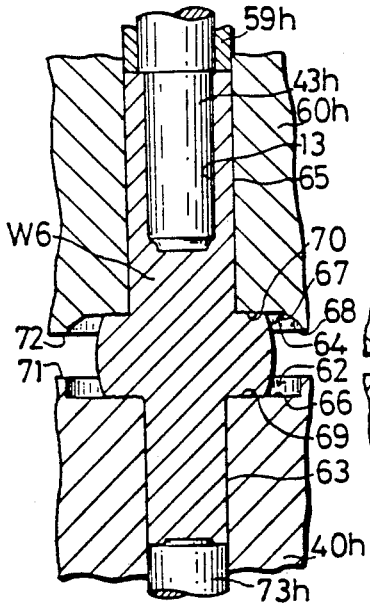
FIGS. 10, 11 and 12 are cross-sectional views showing the process of forming the flange.
Figure 11:
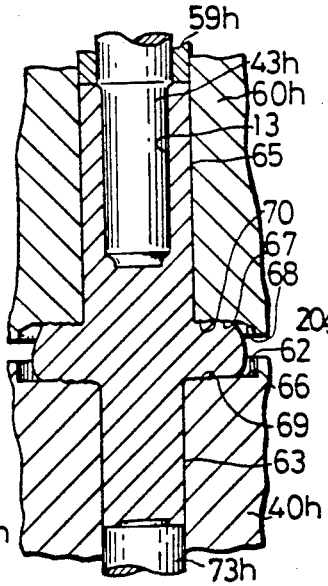
Figure 12:
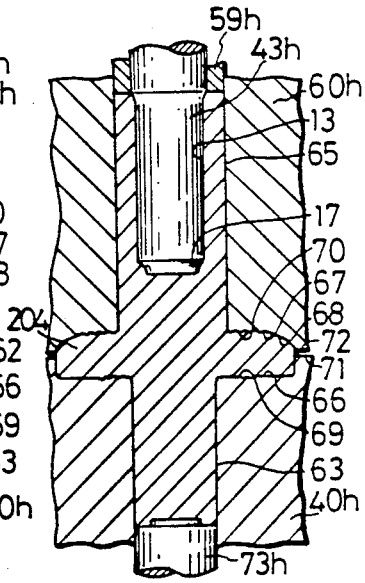
Figure 13:
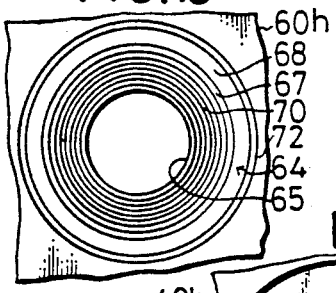
FIGS. 13 and 14 are plan views showing the cavities of a pair of dies for forming the flange.
Figure 14:
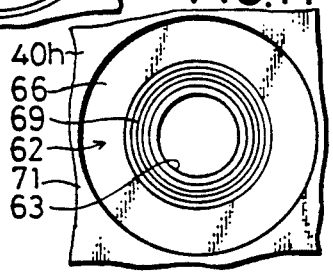

These forming processes are carried out by the station shown in FIG. 7. In this station, the die breast 30 has a die 40*h* and the ram has another die 60*h*. The die 60*h* is secured to a die holder 61*h* mounted to the ram. As shown in FIGS. 10 to 12, the cavities in the dies 40*h*, 60*h* include larger-diameter recesses 62, 64 for forming a flange and smaller-diameter recesses 63, 65 for holding the circumference of the workpiece. A bottom surface 66 of the recess 62 is generally flat. A bottom surface 67 of the recess 64 is inclined at 68 around the circumference. The bottom surfaces 66, 67 are formed with a large number of fine circular grooves and raised strips arranged concentrically on the inner circumferential areas 69, 70, as shown in FIGS. 13 and 14. These provides resistance against the plastic flow of the workpiece material, which will be described in detail later.

The forming at this station is done as follows. One end of the workpiece W6 is set in the recess 63 of the die 40*h*. Then the die 60*h* is advanced together with the punch 43*h* toward the die 40*h*. As a result, the front end of the punch 43*h* engages with the filter mounting hole 13 and the recess 65 receives the other end portion or upper portion of the workpiece W6. Insertion of the pucnh 43*h* in the filter mounting hole 13 serves to prevent deformations on the filter mounting hole 13 during the process of forming the flange 204. As the die 60*h* continues to advance, the workpiece W6 begins to be compressed at the intermediate portion as shown in FIG. 10. The material at the intermediate portion of the workpiece W6 being compressed flows radially outwardly along the bottom surfaces 66, 67 of the recesses 62, 64. The inner circumferential areas 69, 70 of the bottom surfaces 66, 67 have fine circular grooves and raised strips as mentioned earlier and thus form rough surfaces restraining the material flow. The rough surfaces provide resistance against the material flow, limiting the flow speed. The rough area 70 is greater in width (in the radial direction) than another rough area 69; so that the restraining effect of the rough area 70 is higher than that of the rough area 69. This causes the material flow along the bottom surface 70 to proceed slower than the material flow along the bottom surface 69, as shown in FIG. 11. As the material flow along the bottom surface 70 further proceeds, the material reaches the inclined surface 68. At the inclined surface 68, the material generally flows fast. Thus, as shown in FIG. 12, when the die **60*h* has completed its advance, the front end of the material flowing along the bottom surface 66 and the front end of the material flowing along the bottom surface 67 reach almost at the same time the location where the front surface 71 of the die 40 and the front surface 72 of the die 60*h* meet. This is how the flange 204 is formed, and the flange 204 is correctly finished strictly according to the shape of the bottom surfaces 66, 67. Moreover, no flash is formed, which would otherwise be formed by the material flowing into the gap between the front surfaces 71 and 72 of the dies 40*h* and 60*h*. The widths of the rough areas 69, 70 are determined so as to properly control the material flow speeds along the bottom surfaces 66, 67 as mentioned above. As other means of controlling the material flow, it is possible to provide different sizes or pitches of the grooves and raised strips to the rough areas 69 and 70**.

The fact that the rough areas 69, 70 are provided on both the inner circumferential portions of the bottom surfaces 66, 67 produces the following advantages. The more inside the material flows on the bottom surfaces 66, 67, the faster the material flow speed. And as the material flows sliding on the botton surfaces, a large amount of heat is generated by friction. The heating is such that the material is melted fusing with the bottom surfaces. However, at the rough areas 69, 70 the material is caught by the grooves and raised strips, thus preventing it from sliding. Furthermore, since the rough areas 69, 70 are located at the inner circumferential portions, heat generation by friction at these portions, where the material flow speed would be highest, i.e., the heat generation would be greatest, can be restrained. As a result, the fusing of material with the bottom surfaces can be prevented. The grooves and raised strips forming the rough surfaces may be formed in shapes other than concentric arrangements, for instance in spiral forms.

During the process of forming the flange 204, the front end portion of the die holder **61*h* engages with a guide recess 74 formed in a die case 39*h* to guide the movement of the die holder 61*h*. This correctly centers the dies 40*h* and 60*h* with each other, enhancing the dimensional accuracy of the flange 204**.

At the same time that the flange 204 is formed, the circumferential edges 16, 17 are formed by the punch **43*h* and the center 18 is formed by a piercer 73*h*. After this, the die 60*h* and the punch 43*h* are retracted. At this time, a stripper sleeve 59*h* performs the same function as that of the stripper sleeve 59*g*. Then, the stripper sleeve 59*h* is retracted and the workpiece W7 thus formed is pushed out by the piercer 73*h***.

Next, the workpiece W7, shown at I of FIG. 1, is formd with a spring mounting hole 19 to produce a workpiece W8.

Figure 8:
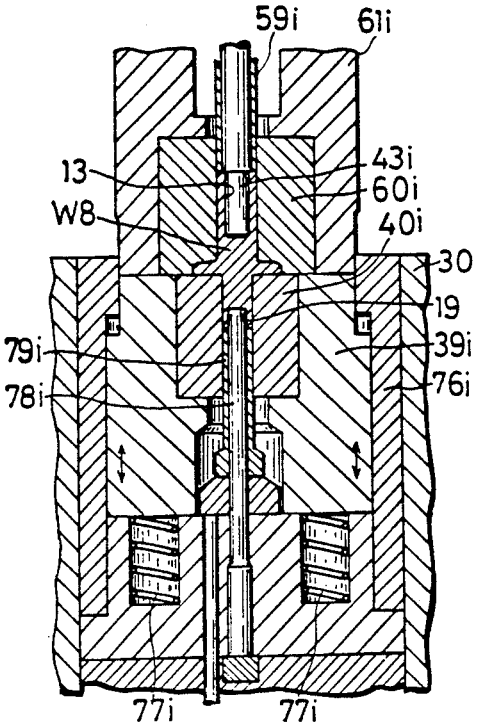

The above forming is done by a station of FIG. 8. In this station, a die case **39*i* is installed in a die sleeve 76*i* so that the die case 39*i* can be moved in the direction of arrow. The die case 39*i* is urged upward in the figure by springs 77*i*. The workpiece W7 is inserted in the cavity of a die 40*i*. As a die 60*i* and a punch 43*i* move toward the die 40*i*, the workpiece W7 is clamped by these dies 40*i*, 60*i* and the punch 43*i* moves into the filter mounting hole 13. The insertion of the punch into the filter mounting hole is made to prevent deformation of the filter mounting hole 13. As the die 60*i* advances further and presses against the die 40*i*, the die case 39*i* retracts against the force of the spring 77. As a result, the piercer 78*i* moves into the workpiece W7, forming the spring mounting hole 19. Now, a workpiece W8 is obtained. The punch 43*i* and the die 60*i* are retracted and then the stripper sleeve 59*i* is also retracted. After this, the workpiece W8 is pushed out of the die 40*i* by a knockout sleeve 79*i***.

Next, the workpiece W8, shown at I of FIG. 1, is formed with a support hole 20 at the bottom of the filter mounting hole 13, the support hole 20 being used to support the receiver die in the next process. A recess or a center 21 is formed at the bottom of the spring mounting hole 19 and a workpiece W9 is obtained.

Figure 9:
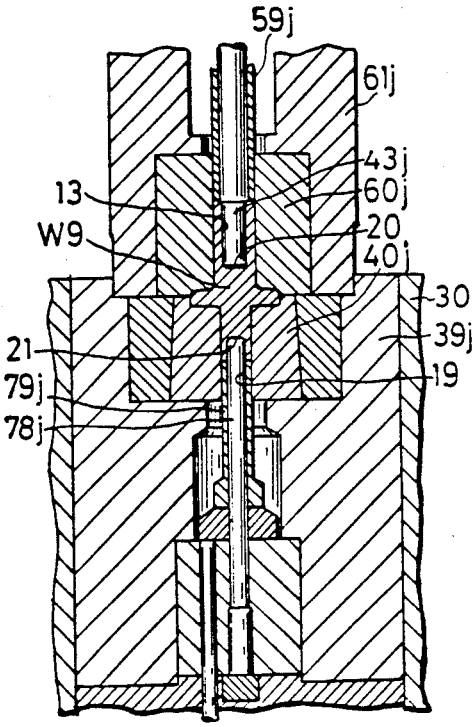

These forming operations are done by a station shown in FIG. 9. The wrokpiece W8 is set in the cavity of a die **40*j*, and a die 60*j* and a punch 43*j* are advanced toward the die 40*j*. This causes the puch 43*j* to move into the filter mounting hole 13 and at the same time the die 60*j* sleeves over the workpiece W8. As the die 60*i* further advances, the bottom of the spring mounting hole 19 abuts against a piercer 78*j*. As a result, the piercer 78*j* forms a center 21 at the bottom of the spring mounting hole 19. The front end of the punch 43*j* presses against the bottom of the filter mounting hole 13 and forms the support hole 20. After this, the die 60*j*, punch 43*j* and sleeve 59*j* are retracted and then the workpiece W9 is pushed out by a knockout sleeve 79*j***.

The workpiece W9 thus formed undergoes cleaning, annealing and surface-hardening treatment. Cleaning is done to remove oil adhering to the surface of the workpiece W9. If the workpiece W9 is annealed with oil attached to it, the oil is carbonized and sticks to the workpiece W9. However, such carbon sticking is prevented since oil is removed before annealing. Annealing is done to soften the workpiece W9 which was hardened during the forming processes of F to J. This facilitates forming the sleeve insertion hole, which is described later. Annealing is performed at, say, 750° C. for three hours. The annealing is preferably a non-oxidizing annealing. The purpose of the surface-hardening treatment will be given during the course of explaining the sleeve insertion hole forming process. The surface-hardening may, for example, be accomplished by a shot blasting.

The workpiece W9 that is surface-hardened is further formed into shapes shown at K to P of FIG. 1 before it becomes a fuel injector core 202. Forming into shapes K to P is done by a cold forging machine, for example, a transfer former which has give stations as shown in FIGS. 15, 17 to 20. The transfer former is equipped with a die breast 80 with the five stations, and a ram which is movable toward and away from the die breast 80. As the ram moves to and form the die breast 80, the processes described below are performed simultaneously at respective stations. The above processes may also be performed by separate forging presses.

The workpiece W9 is first formed into a workpiece W10 with the sleeve insertion hole 210, as shown at K of FIG. 1. The sleeve insertion hole 210 is formed in such a way that a thin portion 27 remains at the bottom of the hole. Reference numeral 28 signifies a slug chip that was produced by the plastic flow of material when the sleeve insertion hole 210 is formed.

Figure 15:
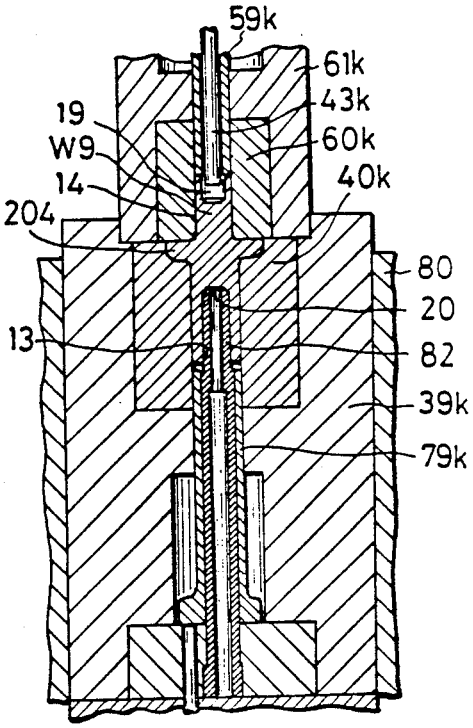
FIGS. 15 and 16 are cross-sectional views of devices used to form the workpiece into the shape of K of FIG. 1.
Figure 16:
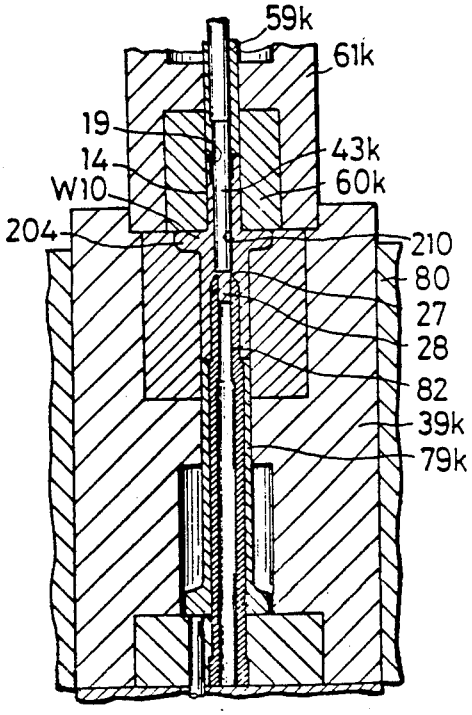
Figure 21:
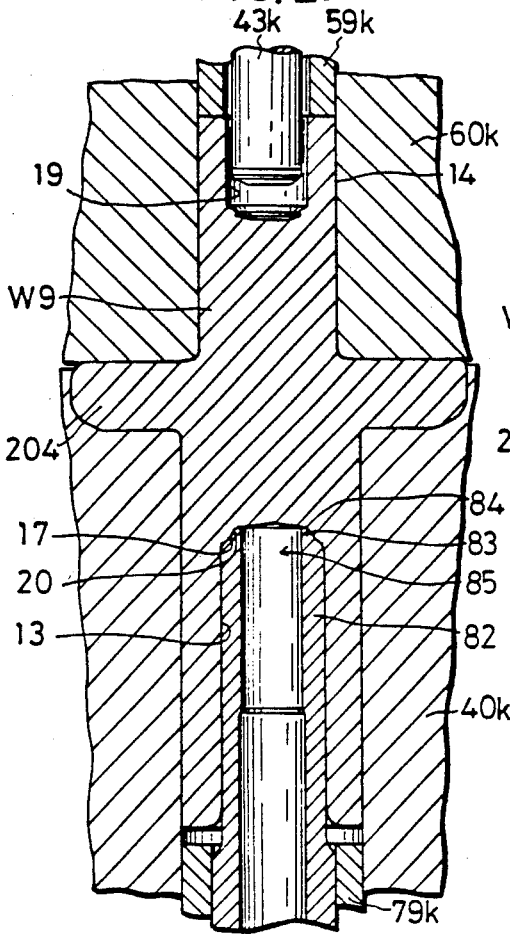
FIGS. 21 and 22 are enlarged cross-sectional views showing the essential portion of FIGS. 15 and 16.

This process is done by the station shown in FIGS. 15 and 16. As shown in FIG. 15, the workpice W9 is set in the cavity of a die 40*k*, with a receiver die 82 inserted in the filter mounting hole 13. A die 60*k* is sleeved over a small-diameter portion 14 of the workpiece W9. In this way, the workpiece W9 is held at its circumference by the dies 40*k*, 60*k*. The receiver die 82 is also called an insert punch and formed hollow. The outer side of the front end of the insert punch 82 is drawn to form a small-diameter portion 83, as shown in FIG. 21, which fits into the recess 20 in the workpiece W9. The front end surface 84 of the small-diameter portion 83 forms an annular abutting surface. The interior surrounded by the abutting surface 84 is a recess 85 that can accommodate the slug 28. The recess 85 may have a bottom. The receiver die 82 of this structure receives one surface of the axis of the workpiece W9.

Figure 22:
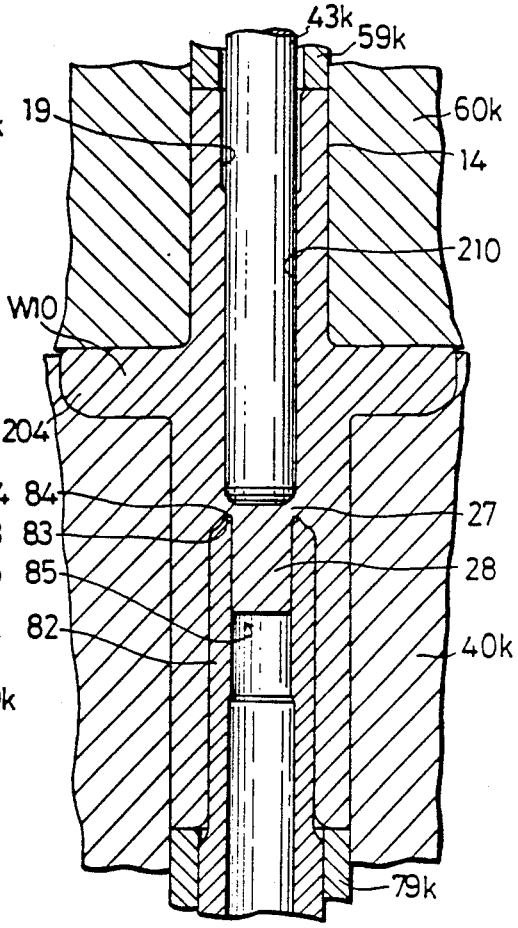
Figure 23:
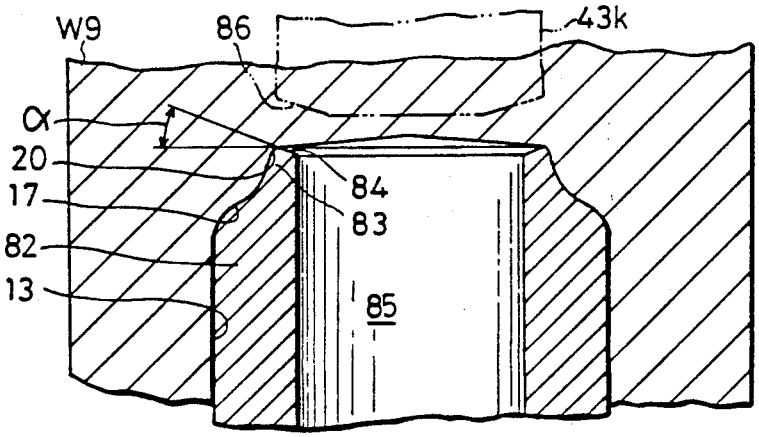
FIG. 23 is a cross-sectional view showing the detail of relationship between the workpiece and the receiver die.

Under the above condition, the punch 43*k* is pushed into the workpiece W9 as shown in FIGS. 16 and 22 to form the sleeve insertion hole 210. In this process, a part of the material expelled by the punch 43*k* flows toward the insert punch 82. The plastic flow moves toward the outside and inside of the insert punch 82. The plastic flow toward the outside of the insert punch 82 causes the workpiece W9 to elongate toward the knockout sleeve 79*k*, as shown in FIGS. 16 and 22. The front end of the elongated workpiece contacts the knockout sleeve 79*k* and stops there. The plastic flow toward the inside of the insert punch 82 pushes the slug 28 into the recess 85 of the insert punch 82. Now, the workpiece W9 is formed into a workpiece W10 with the sleeve insertion hole 210. After the workpiece W10 is formed, the punch 43*k* and the die 60*k* are retracted, followed by retraction of a stripper sleeve 59*k*. Then, the knockout sleeve 29*k* pushes the workpiece W10 out of the die 40*k*.

Figure 24:
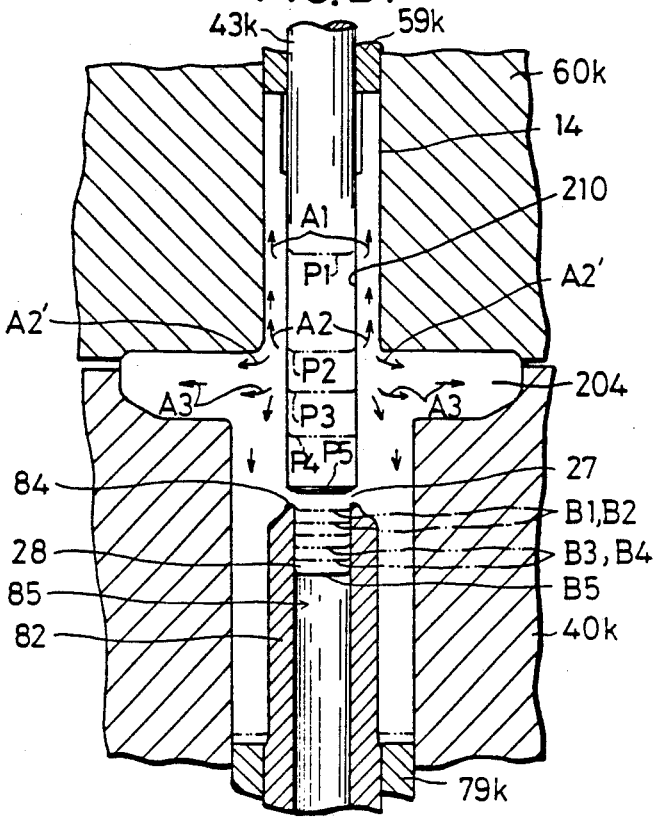
FIG. 24 is a view explaining the plastic flow of the workpiece material that occurs when the sleeve insertion hole is formed in the workpiece.

Now, by referring to FIG. 24, detailed description is made as to the plastic flow of the workpiece material as the punch 43*k* is pressed into the workpiece W9. As shown by P1, the punch 43*k* begins to be pressed into the workpiece W9. At this time the workpiece material expelled by the punch 43*k* flows slightly toward the insert punch 82 and, as shown by b1, a small amount of material 28 is pushed into the recess 85. The majority of the expelled material flows backward as indicated by the arrow A1. As a result, the small-diameter portion 14 extends in the direction of arrow A1. As the small-diameter portion 14 extends, the stripper sleeve 59*k* retracts, pushed by the front end of the small-diameter portion 14. A similar plastic flow process occurs when the punch 43*k* is pushed close to the flange 204 as indicated by P2. That is, the material of the workpiece W9 flows mainly backward as indicated by the arrow A2 and the flow of material 28 into the recess 85 is small as indicated by B2. When the punch 43*k* comes close to the base of the flange 204, the backward flow of the material ceases. As the punch 43*k* moves from P2 to P3, passing a part of the flange 204, the material flow toward the insert punch 82 increases, with the result that the amount of material 28 extruded into the recess 85 also increases as shown by B3. As the punch 43*k* further advances as indicated by P4 and P5, the amount of material 28 being pushed into the recess 85 further increases as indicated by B4 and B5. When the punch 43*k* reaches a specified depth marked by P5, the punch 43*k* is stopped. As the punch 43*k* moves past the flange 204, the material of the workpiece W9 also flows into the flange 204 as indicated by the arrows A2' and A3. This causes the flange 204 to be pressed against the inner surfaces of the cavities of the dies 40*k*, 60*k*.

During the process of pushing the punch 43*k*, retraction of the die 60*k* is completely prevented so that when the material flows backward as indicated by the arrows A1, A2, the die 60*k* will not be retracted together with the backward flowing material. As a result, a trouble can be prevented in which a gap is formed between the flange 204 and the die 60*k* and in which the material flows into the gap bulging the flange.

The cross sections of the workpiece W9 in front of and behind the flange 204 differ greatly. Thus, when the punch 43*k* moves past the flange 204 from P2 to P4, it is subjected to a tensile or compressive stress. If these stresses are excessively large, the punch 43*k* may break. The compressive force of the material of the workpiece W9, caused as the punch 43*k* is pushed into the workpiece, is used, in large part, for extruding the material into the recess 85 of the insert punch 82. Therefore, the stress to which the punch 43*k* is subjected is small and the possibility of the punch 43*k* being broken is also very small. Furthermore, since the stress is small, the sleeve insertion hole 210 thus formed has almost no variations in the inner diameter along the axis.

In every part of the workpiece W9 except for the small-diameter portion 14, the cross section is very large as compared with the cross section of the punch 43*k*, so that the reduction in cross section as a result of the punch 43*k* being pushed is small. Generally, when the reduction in cross section is small, the plastic flow will not easily occur. This increases the compressive pressure of the material, causing a centrifugal force to act on the punch. That is, the punch 43*k* is subjected to a force which tends to deflect the punch 43*k* laterally from the axis of the workpiece W9. However, in this embodiment, a part of the material 28 flows into the recess 85 of the insert punch 82, releasing the pressure of the material of the workpiece W9. This in turn prevents the generation of the centrifugal force on the punch, thus eliminating the tendency of the sleeve insertion hole 210 to be off-centered.

The outer circumferential surface of the small-diameter portion 83 at the front end of the insert punch 82 is snugly fitted in the inner circumferential surface of the support hole 20 without a gap. Thus, if the material 28 extruded into the recess 85 exerts a large radially outward force to the insert punch 82, the force is received by the inner circumferential surface of the support hole 20. The force is further received through the workpiece W9 by the die 40*k*. As a result, the insert punch 82 can be prevented from being damaged.

The annular abutting surface or receiver surface 84 at the front end of the insert punch 82 is shaped like a dish which is inclined at an angle of $\alpha$ (say, 15°) with respect to a plane perpendicular to the axis of the insert punch 82. This angle is set equal to the inclination of the outer circumferential portion 86 at the front end of the punch 43*k*. Because of the presence of such an inclination $\alpha$, the material expelled by the punch 43*k* smoothly flows towrd the recess 85 of the insert punch 82. This material flow increases the centripetal tendency of the punch 43*k*, which in turn heightens the accuracy of center of the sleeve insertion hole 210 being formed. That is, the centripetal material flow contributes to forming the sleeve insertion hole 210 without any deviation of center. With the sleeve insertion hole 210 formed with high precision of center, a web 27 that remains between the receiver surface 84 and the front end surface 86 is uniform in thickness over the entire circumference. This uniformity in web thickness facilitates the next process of removing the slug 28.

In the process of forming the sleeve insertion hole 210 by the punch 43*k*, the depth to which the punch 43*k* is pushed is determined as follows.

When the punch 43*k* is pressed into the workpiece and as the distance between the front end surface 86 of the punch 43*k* and the receiver surface 84 of the receiver die 82 becomes extremely small, a fracture of material initiates on the inner circumferential surface of the hole formed by the punch 43*k* at a point close to the residual portion 27 between the front end surface 86 and the receiver surface 84. At the fractured portions, the material structure is discontinuous and the material particles are large and easily come off. The particles that came off from the material body causes the aforementioned problem. Hence, it is necessary to stop pushing the punch 43*k* before it reaches the depth at which the fracture begins.

The remaining portion 27 must be punched out in the next process. The force required for the punching out decreases as the thickness of that portion 27 becomes small. Thus, it is desired that the depth of the punch be set as deep as possible to make the residual portion 27 thin.

When the residual portion 27 is punched out, a fractured surface remains there. Particles on the fractured surface are finer as the residual portion 27 becomes thinner because the thinner the residual portion 27, the greater the stress to which the residual portion is subjected. Conversely, as the residual portion 27 becomes thicker, the particles on the fractured surface are coarser because the residual portion 27 is subjected to less stresses. In the fractured surface with fine particles, dislocation of particles will not easily occur. On the contrary, the fractured surface with coarse particles will have its particles easily dislocated. In this respect, it is preferred that the thickness of the residual portion 27 be small.

Furthermore, the punched-out portion, even subjected to an inner surface finish described later, still has the possibility of particles coming off, which cannot be made zero. For this reason, the punched-out portion cannot be used for accommodating the sleeve 211. From this respect, too, it is desired that the thickness of the residual portion 27 be small. Various standards from fuel injector makers have dimensional limits on the range of unusable area, such as 2 mm or 1.2 mm.

From the above considerations, the punch depth should be set as great as possible to make the distance between the front end surface 86 of the punch 43*k* and the receiver surface 84 of the receiver die 82 as small as possible within a range in which the continuity of material structure is maintained on the inner circumferential surface of the hole formed by the punch 43*k*.

Next, we will describe the inner diameter of the recess 85 in the insert punch 82. One preferable value of the inner diameter is approximately 85% of the outer diameter of the punch 43*k*. When this inner diameter is too small when compared with the outer diameter of the punch 43*k*, a large force is required to extrude the material 28 into the recess 85. This in turn increases the load on the punch 43*k* and also the chance of the punch being broken. Further, since the length of the material 28 extruded into the recess 85 becomes longer, the insert punch 82 is more likely to be damaged. For these reasons, the inner diameter of the recess 85 should preferably be set more than 70 to 80% of the outer diameter of the punch 43*k*. On the contrary, when the inner diameter of the recess 85 is too large, a fracture initiates on the inner surface of the sleeve insertion hole 210 even when the thickness of the residual portion 27 is still large. This means that the residual portion 27 left has a large thickness. It is therefore desirable that the inner diameter of the recess 85 be set less than 90 to 95% of the outer diameter of the punch 43*k*. However, where a long unusable area on the sleeve insertion hole 210 is permitted, the inner diameter of the recess may be set equal to the outer diameter of the punch 43*k*.

When the sleeve insertion hole 210 is formed, the workpiece W9 is hardened on the surface by the aforementioned surface hardening treatment. This prevents outer circumferential surface of the workpiece W9 from fusing with the inner surfaces of the dies 60*k*, 40*k* due to the friction caused by plastic flow when the punch 43*k* is pressed into the workpiece. The surface hardening is done by the shot blasting, so that the workpiece has fine depressions and rises on the surface. This means that the surface of the workpiece has relatively small effective areas in contact with the inner surface of the dies 60*k*, 40*k*. Therefore, after the punch 43*k* has completed its pressing stroke, the die 60*k* can easily be retracted and the workpiece W10 can easily be pushed out of the die 40*k*.

The workpiece W10 with the sleeve insertion hole 210 formed therein is now removed of the residual portion 27 at the bottom of the hole 210 and the slug 28, and a workpiece W11 as shown at L of FIG. 1 is obtained.

Figure 17:
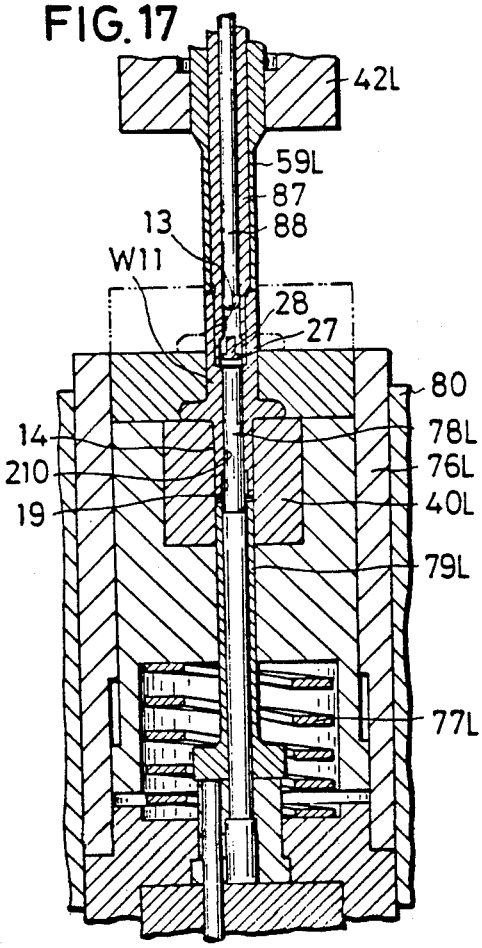
FIGS. 17, 18, 19 and 20 are cross-sectional views of devices used to form the workpiece into the shapes of L, M, N and P of FIG. 1.

The above work is done at a station of FIG. 17 in a manner similar to that of the station of FIG. 8. That is, workpiece W10 is set in the cavity of a die 40L. A stripper sleeve 59L and a cylindrical receiver die 87—a cylindrical insert punch which is different from the previous receiver die 82—advance toward the die 40L until the sleeve 59L contacts the end of the workpiece W10 and the receiver die 87 contacts the bottom of the filter insertion hole 13. After contact, they each push the workpiece W10. Then a piercer 78L comes into the sleeeve insertion hole 210 of the workpiece W10 to punch out the thin residual portion 27 and the slug 28. After this, the sleeve 59L and the insert punch 87 are retracted. Then a knockout sleeve 79L pushes the punched workpiece W11 out of the die 40L. The punched-out portions (the slug 28 and the residual portion 27) are removed by a slug knock 88.

Figure 25:
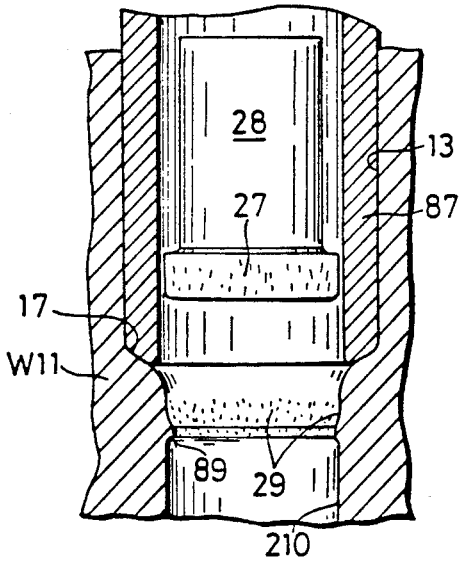
FIG. 25 is an enlarged cross-sectional view of the essential portion of FIG. 17.

The workpiece W11 which has just been punched has a rough fractured surface on the inner circumferential surface 29 where the residual portion is punched out, as shown in FIG. 25. There is a step 89 between the punched-out surface 29 and the inner circumferential surface of the sleeve insertion hole 210 formed by said punch 43K. The inner circumferential surface 29 is therefore corrected as shown at M of FIG. 1 and in FIG. 26.

Figure 18:
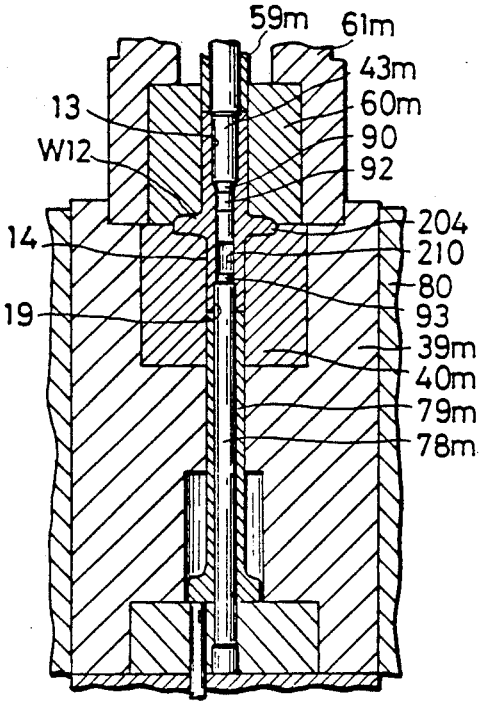
Figure 26:
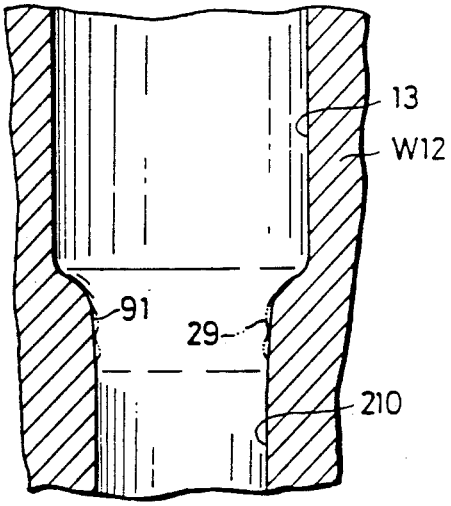
FIG. 26 is a cross-sectional view of a punched workpiece with the fractured surface smoothed.

This correction work is done at a station of FIG. 18. The workpiece W11 is set in the cavity of a die 40*m* and held by a die 60*m*. A tapered portion 90 of a punch 43*m* is pressed against the inner circumferential surface 29 to make the surface 29 a smooth tapered surface 91, as shown in FIG. 26. The area of the tapered surface 91 is so determined as to be within an allowable range of the unusable area of the sleeve insertion hole 210. The angle of taper may, for example, be 6°. It is preferably within a range of 1° to 10°. The tapered surface 91 serves as a guide to facilitate the insertion of the spring 207 and the sleeve 211 from the filter mounting hole 13 into the sleeve insertion hole 210 during the process of fuel injector assembly. The workpiece W12 with the above correction done is pushed out of the die 40*m* by a knockout sleeve 79*m* after the punch 43*m* and the die 60*m* are retracted.

During the above forming process, a straight portion 92 at the front end of the punch 43*m* and a straight portion 93 at the front end of the piercer 78*m* are inserted into the sleeve insertion hole 210. These straight portions 92, 93 prevent the shrinking deformation of the sleeve insertion hole 210 during the taper forming.

The workpiece W12 may have the dimensional accuracy of the sleeve insertion hole 210 degraded by the slug punching and the correction of the inner tapered surface. For improving the dimensional accuracy of the sleeve insertion hole 210 up to the standard level, a master punch is inserted into the sleeve insertion hole 210. A workpiece W13 which has undergone the dimensional accuracy improvement process is shown at N in FIG. 1.

Figure 19:
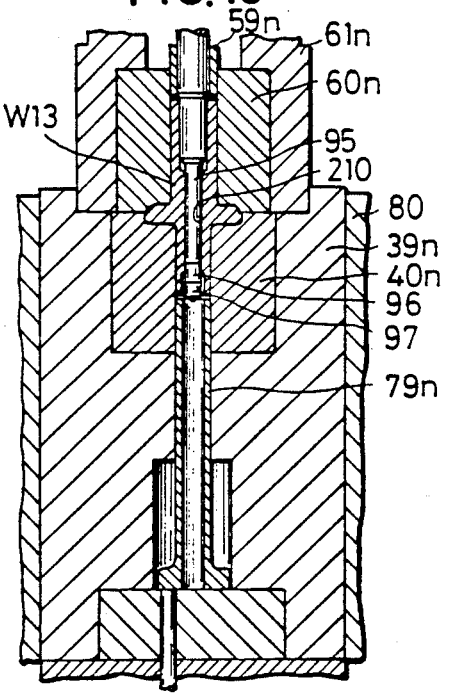

The above work is done at a station shown in FIG. 19. That is, the workpiece W12 is held by dies 40*n*, 60*n* and the master punch 95 is inserted into the sleeve insertion hole 210. The master punch 95 has at its front end a probe portion 97, which is slightly smaller in diameter than the master punch body and smoothly continuous therewith through a tapered portion 96. The probe portion 97 guides the punch 95 smoothly into the sleeve insertion hole 210, thus preventing the inner surface of the sleeve insertion hole 210 from being damaged. This process may be omitted.

Next, the flange 204 of the workpiece W13 is formed with a large number of V-shaped grooves 98 for preventing the turn of the workpiece, and at the same time the filter mounting hole 13 is finished. Now a completed core 202 is obtained.

Figure 20:
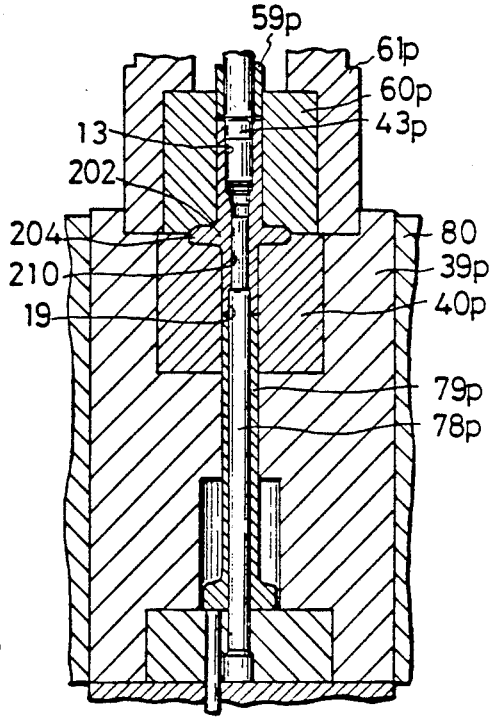

The above process is performed by a station shown in FIG. 20. A die 60*p* on this station has a large number of raised strips formed in its flange cavity to form the V-shaped grooves on the flange 204. Pressing the raised strips against the flange 204 of the workpiece W13 forms the V-shaped grooves 98 on the flange.

FIGS. 27 through 30 show another embodiment of this invention. In this embodiment, the sleeve insertion hole is punched from a side opposite to that from which the punching was done in the preceding embodiment.

Figure 27:
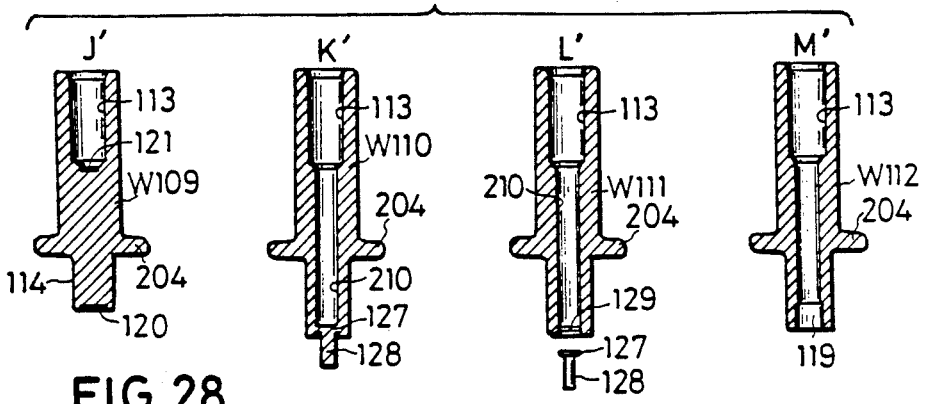
FIG. 27 is a cross-sectional views showing a sequence of changes in the shape of a workpiece according to another embodiment of the invention.

The workpiece, which has its flange 204 formed in processes similar to those up to H in the first embodiment, further has a support hole 120 for the receiver die formed at the front end surface of the small-diameter portion 114 and a recess or center 121 formed at the bottom of the filter mounting hole 113 as shown at J' of FIG. 27. The workpiece W109 then is subjected to cleaning, annealing and surface-hardening treatment, as in the first embodiment, after which the sleeve insertion hole 210 is punched from the side of the filter mounting hole 113 as shown at K'.

Figure 28:
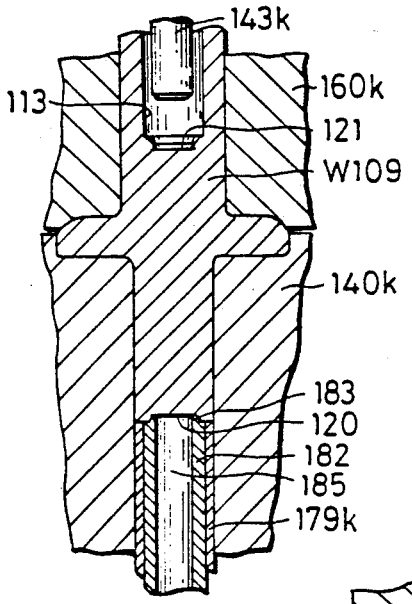
FIGS. 28 and 29 are cross-sectional views showing the process of forming the sleeve insertion hole in the workpiece of FIG. 27.
Figure 29:
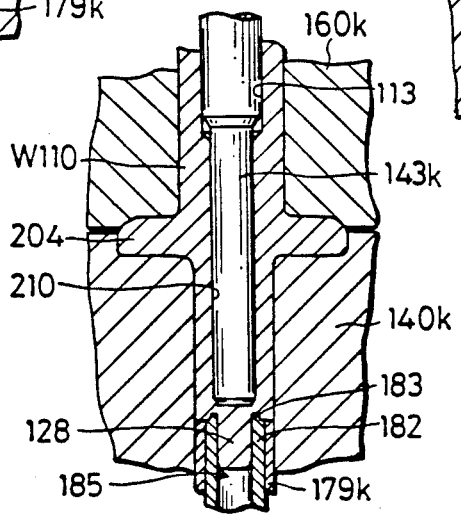
Figure 31:
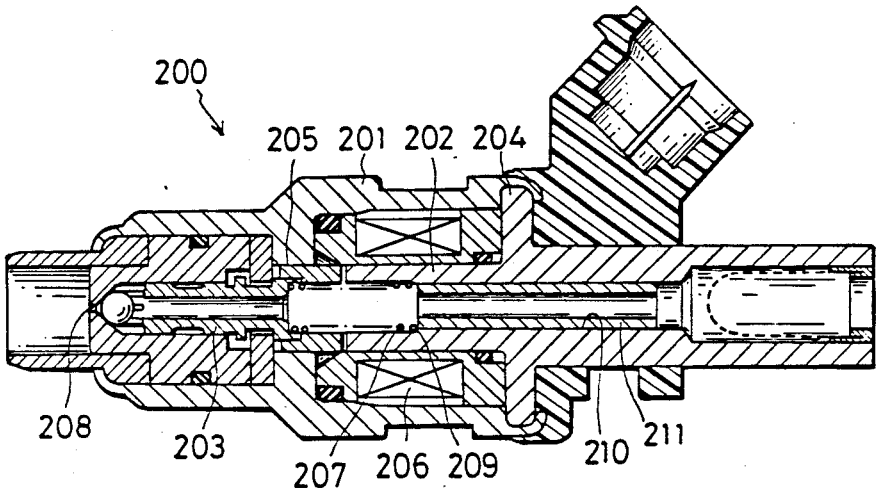
FIG. 31 is a cross-sectional view of a fuel injector.

The sleeve insertion hole 210 is formed as shown in FIGS. 28 and 29. First, the workpiece W109 is held at its circumference by dies 140*k*, 160*k*. The small-diameter portion 183 of a receiver die 182 is set against the support hole 120. The stepped portion at the front end of the receiver die 182 and the front end of a knockout sleeve 179*k* are placed in contact with the end surface of the workpiece W109 around the support hole 120. In this state, as shown in FIG. 29, a punch 143*k* is pressed into the workpiece from the recess 121 of the filter mounting hole 113 beyond the flange 204, pushing the slug 128 into a recess 185 of the receiver die 182.

The workpiece W110 that has undergone the above process is cleared by the residual portion at the bottom of the sleelve insertion hole 210 to produce a workpiece W111, as shown at L' of FIG. 27.

Figure 30:
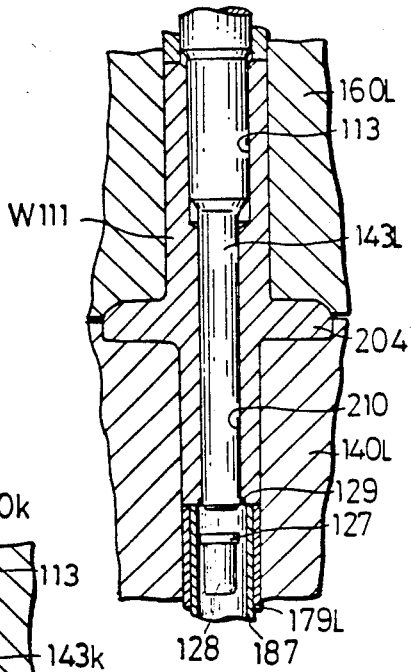
FIG. 30 is a cross-sectional view showing the remaining part at the bottom of the sleeve insertion hole of FIG. 27 punched out.

The punching out of the residual portion is done as shown in FIG. 30. The workpiece is held by dies 140L and 160L, with its end surface received by a second receiver die 187 and a knockout sleeve 179L. In this condition the thin residual portion 127 and the slug 128, which remain at the bottom of the sleeve insertion hole 210, is punched out by the punch 143L.

Then, the workpiece W111 is formed with a small spring insertion hole 119, as shown at M' in FIG. 27. The formation of the small hole 119 makes smooth the fractured surface 129 from which the residual portion was removed. The workpiece W112 with the small hole 119 thus formed undergoes successive processes similar to those of the first embodiment, such as insertion of the master punch and formation of V-shaped grooves on the flange 204. Now, a complete core is obtained.

What is claimed is:

1. A method of producing a core for a fuel injector comprising the steps of:

(a) providing a first pair of dies having, at the respective opposing surface thereof, larger-diameter recesses for forming a flange and smaller-diameter recesses for holding the circumferential surface of a workpiece, said smaller-diameter recesses being at the central portion of said larger-diameter recesses, (b) holding a first side and a second side of a bar-like workpiece with said smaller-diameter recesses in said first pair of dies, (c) causing material at an intermediate portion of said workpiece exposed between said smaller-diameter recesses to flow plastically into said larger-diameter recesses in said first pair of dies by bringing said first pair of dies closer to each other and filling said larger-diameter recesses with said material to form a first flange, (d) providing a second pair of dies, (e) holding by said second pair of dies all of the circumferences of a bar-like portion and of said flange formed at the intermediate portion thereof in a second workpiece formed with said flange, (f) receiving one axial end surface of said bar-like portion in said workpiece by a receiver die which has the central portion of the end surface thereof formed into a recess and the circumferential surface thereof formed into a receive surface for receiving said workpiece, (g) continuously pressing a first punch into said workpiece from a side opposite to said receiver die beyond the position of said flange up to a specified depth for forming a sleeve insertion hole, (h) pressing in said first punch, causing the central portion material at the place to be passed through by said first punch and situated inside said flange to flow plastically in the axial direction towards the side of said recess of said receiver die by said first punch pressed in and of forming a slug protruding into said recess of said receiver die, and (i) punching out by a second punch residual material left at the bottom of the hole which has been bored by pressing in said first punch.

2. A method of producing a core for a fuel injector as set forth in claim 1, wherein the depth to which the punch is pressed into the workpiece is made within a range in which a continuity in the material structure of the workpiece can be maintained on the inner circumferential surface formed by the intrusion of the punch.

3. A method of producing a core for a fuel injector as set forth in claim 1, wherein prior to the step of forming the flange, the end surfaces of the bar-like workpiece are processed to remove rough surfaces.

4. A method of producing a core for a fuel injector as set forth in claim 1, wherein the step of forming the flange on the bar-like workpiece is carried out by using a pair of dies, each of which has a recess for forming the flange and another recess provided at the bottom center of the former recess for holding the circumference of the workpiece, a part of the bottom surface of the flange forming recess being formed as a rough surface to provide a resistance against the plastic flow of the workpiece material along the bottom surface; and wherein the step of forming the flange consists of holding the workpiece at its ends by the workpiece circumference holding recesses of the dies, and moving the dies toward each other to cause the material at the intermediate portion of the workpiece to flow into the flange forming recesses of the dies, and during the latter step, the rough surfaces at the bottoms of the dies give a resistance against the plastic flow of the workpiece material so that the front end of the material flowing along the bottom surface of one die and the front end of the material flowing along the bottom surface of the other die simultaneously reach a location where the front ends of the dies meet.

5. A method of producing a core for a fuel injector as set forth in claim 1, wherein prior to the step of pressing the punch into the workpiece, the workpiece is formed with a filter mounting hole at one end on the side where it is received by the receiver die.

6. A method of producing a core for a fuel injector as set forth in claim 1, wherein prior to the step of pressing the punch into the workpiece, the workpiece is formed with a filter mounting hole at one end on the side from which the punch is pressed into the workpiece.

7. A method of producing a core for a fuel injector as set forth in claim 1, wherein after the residual material is punched out, another punch is pressed against the fractured surface produced by the punching out of the residual material to transform the fractured surface into a tapered smooth surface for guiding the insertion of a sleeve.

* * * * *